US010575610B1

(12) United States Patent
Li

(10) Patent No.: US 10,575,610 B1
(45) Date of Patent: Mar. 3, 2020

(54) TWO-STAGE FOLDING STRUCTURE FOR TWO-FOLD INVERTED UMBRELLA

(71) Applicant: Sheng-Chun Li, Taoyuan (TW)

(72) Inventor: Sheng-Chun Li, Taoyuan (TW)

( * ) Notice: Subject to any disclaimer, the term of this patent is extended or adjusted under 35 U.S.C. 154(b) by 0 days.

(21) Appl. No.: 16/241,375

(22) Filed: Jan. 7, 2019

(30) Foreign Application Priority Data

Nov. 7, 2018 (TW) ..... 107139495 A

(51) Int. Cl.
*A45B 25/16* (2006.01)
*A45B 19/04* (2006.01)
*A45B 25/08* (2006.01)
*A45B 25/14* (2006.01)

(52) U.S. Cl.
CPC ..... *A45B 25/16* (2013.01); *A45B 19/04* (2013.01); *A45B 25/08* (2013.01); *A45B 25/143* (2013.01); *A45B 2200/1081* (2013.01)

(58) Field of Classification Search
CPC ..... A45B 25/143; A45B 19/04; A45B 25/16; A45B 25/06; A45B 25/14; A45B 25/08; A45B 2200/1081; A45B 25/00
USPC ..... 135/15.1, 22, 24, 25.1, 25.33, 25.4, 28
See application file for complete search history.

(56) References Cited

U.S. PATENT DOCUMENTS 5,617,889 A * 4/1997 Wu ..... A45B 25/143 135/22
5,758,677 A * 6/1998 Wang ..... A45B 25/16 135/20.3
5,823,215 A * 10/1998 Chou ..... A45B 25/143 135/24
5,868,151 A * 2/1999 Kuo ..... A45B 25/143 135/22
6,810,894 B2 * 11/2004 Chen ..... A45B 25/143 135/22
7,735,498 B2 * 6/2010 You ..... A45B 25/143 135/24
7,789,096 B1 * 9/2010 Liu ..... A45B 25/143 135/20.3
7,909,049 B2 * 3/2011 Yang ..... A45B 19/04 135/20.3
8,356,612 B2 * 1/2013 Liu ..... A45B 25/00 135/25.4
8,544,485 B2 * 10/2013 Ko ..... A45B 25/143 135/24
8,757,184 B1 * 6/2014 Chen ..... A45B 19/04 135/20.3
9,282,793 B2 * 3/2016 Chen ..... A45B 25/143

* cited by examiner

*Primary Examiner* — Winnie Yip

(57) ABSTRACT

A two-stage folding structurer for two-fold inverted umbrella includes an umbrella shaft assembly consisting of an inner shaft tube, an outer shaft tube and a handle, and a control device set including a release mechanism mounted in the outer shaft tube, a positioning device mounted in the inner shaft tube, a spring member connected between the release mechanism and the positioning device and a control device mounted to the handle. When the outer shaft tube is received to the inner shaft tube in the received position, the release mechanism is moved close to the positioning device, and a hook of the positioning device is forced to hook in a retaining notch of the release mechanism to lock the outer shaft tube and the inner shaft tube in the received position.

6 Claims, 13 Drawing Sheets

TWO-STAGE FOLDING STRUCTURE FOR TWO-FOLD INVERTED UMBRELLA

BACKGROUND OF THE INVENTION

1. Field of the Invention

The present invention relates to umbrella technology and more particularly, to a two-stage folding structurer for two-fold inverted umbrella, which first folds the umbrella cloth and then retracts the umbrella shaft assembly, and the umbrella shaft assembly can be locked in the received position when folded.

2. Description of the Related Art

A conventional automatic folding umbrella makes the release mechanism close to the positioning device by utilizing the spring member's elastic restoring ability. When the spring member generates an elastic restoring energy, the force changes from small to large. Therefore, when the umbrella is in the received position, the umbrella shaft assembly can be forced to extend out due to the effect of the gravity weight of the umbrella itself if the user holds the umbrella in a downward direction. This will not only cause inconvenience to the user but will also make the spring member fatigue and shorten the service life.

SUMMARY OF THE INVENTION

The present invention has been accomplished under the circumstances in view. It is therefore the main object of the present invention to provide a two-stage folding structurer for two-fold inverted umbrella, which uses a control device to control a release mechanism in unlocking the runner for allowing the runner to move and to push a latch in unlocking the umbrella shaft assembly so that a spring member pulls the umbrella shaft assembly into a received position where the umbrella shaft assembly is locked by hook means to prevent the umbrella shaft assembly from being forced to extend out by the gravity weight itself.

To achieve this and other objects of the present invention, a two-stage folding structurer for two-fold inverted umbrella comprises an umbrella shaft assembly and a control device set. The umbrella shaft assembly comprises an inner shaft tube, an outer shaft tube axially slidably sleeved onto the inner shaft tube, a runner axially slidably sleeved onto the outer shaft tube and a handle affixed to one end of the inner shaft tube opposite to said outer shaft tube. The control device set comprises a release mechanism mounted inside the outer shaft tube, a positioning device mounted inside the inner shaft tube, a spring member connected between the release mechanism and the positioning device, and a control device mounted to the handle. The release mechanism comprises a base, and a retaining notch located on the base thereof near the positioning device. The positioning device comprises a base, an arm extended from the base thereof and terminating in a hook, and a latch disposed at one side thereof. When the runner is positioned in a distal end of the outer tube remote from the handle, the outer shaft tube is extended from the inner shaft tube in an extended position and the latch is exposed to the outside of the outer shaft tube and the inner shaft tube to lock the outer shaft tube and the inner shaft tube in the extended position. When the control device is operated to actuate the release mechanism in unlocking the runner from the outer shaft tube, the runner is moved toward the handle to push the latch in unlocking the outer shaft tube from the inner shaft tube for enabling the spring member to receive the outer shaft tube to the inner shaft tube so that the release mechanism is moved close to the positioning device to engage the hook in the retaining notch in locking the outer shaft tube to the inner shaft tube in a received position.

Other advantages and features of the present invention will be fully understood by reference to the following specification in conjunction with the accompanying drawings.

DETAILED DESCRIPTION OF THE PREFERRED EMBODIMENT

Figure 1:
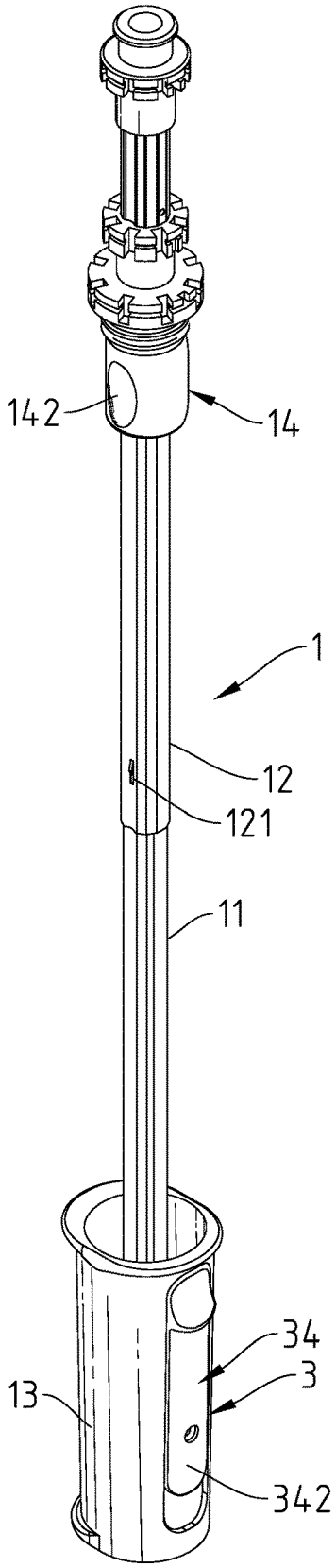
FIG. 1 is an elevational view of an umbrella shaft assembly for two-stage folding structure for two-fold inverted umbrella in accordance with the present invention.
Figure 2:
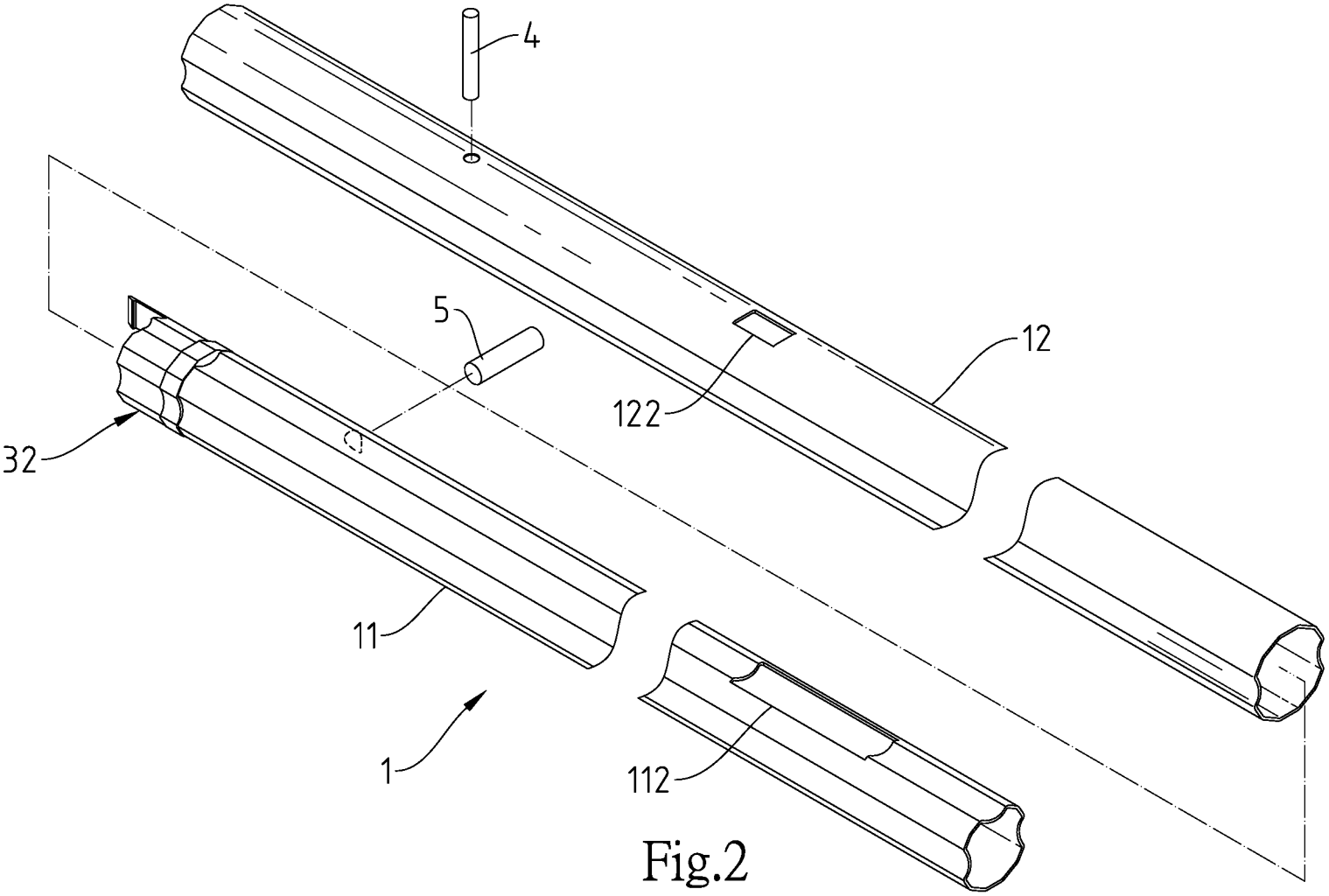
FIG. 2 is an exploded view of the umbrella shaft assembly.
Figure 3:
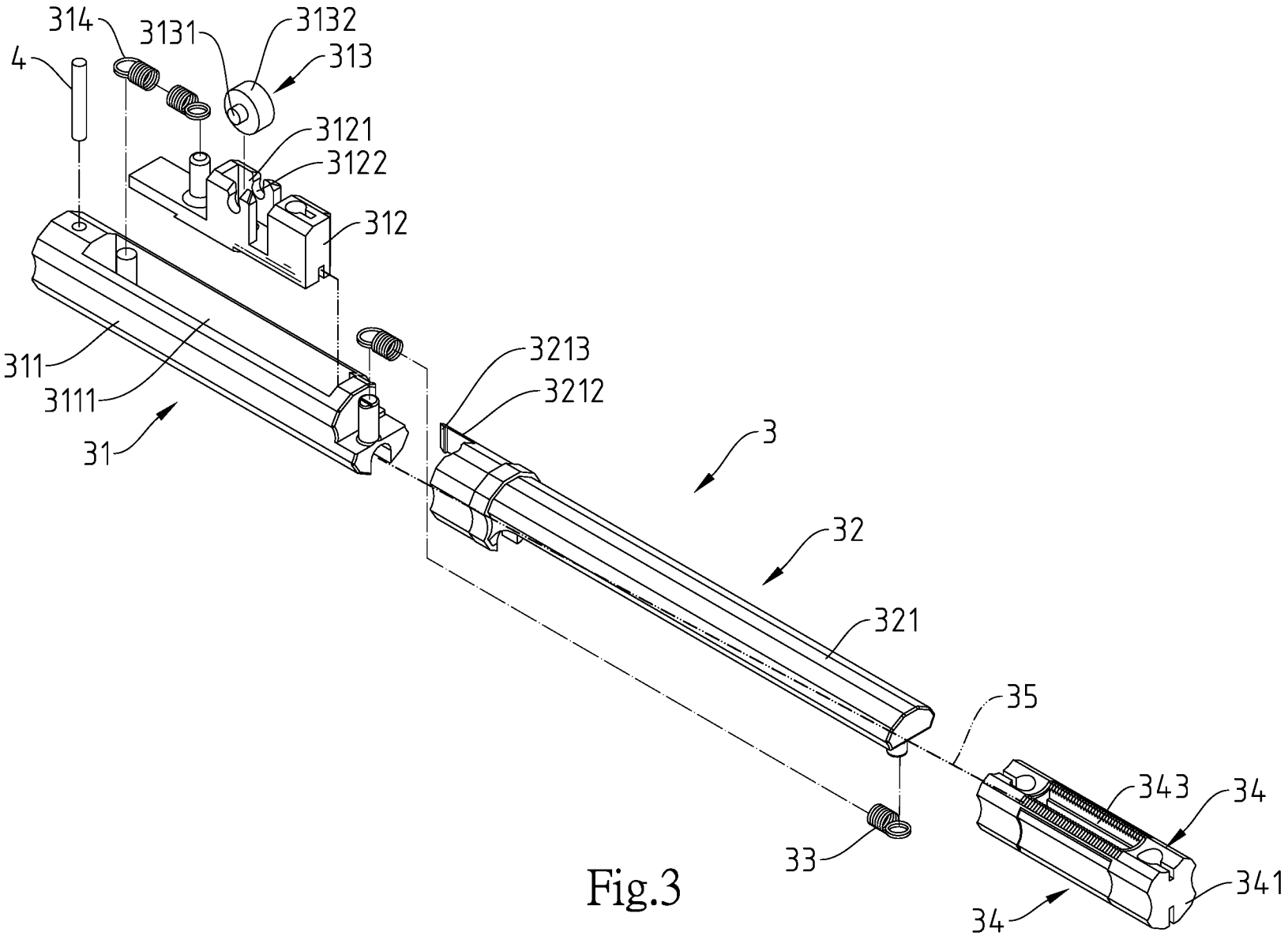
FIG. 3 is an exploded view of the control device set.
Figure 4:
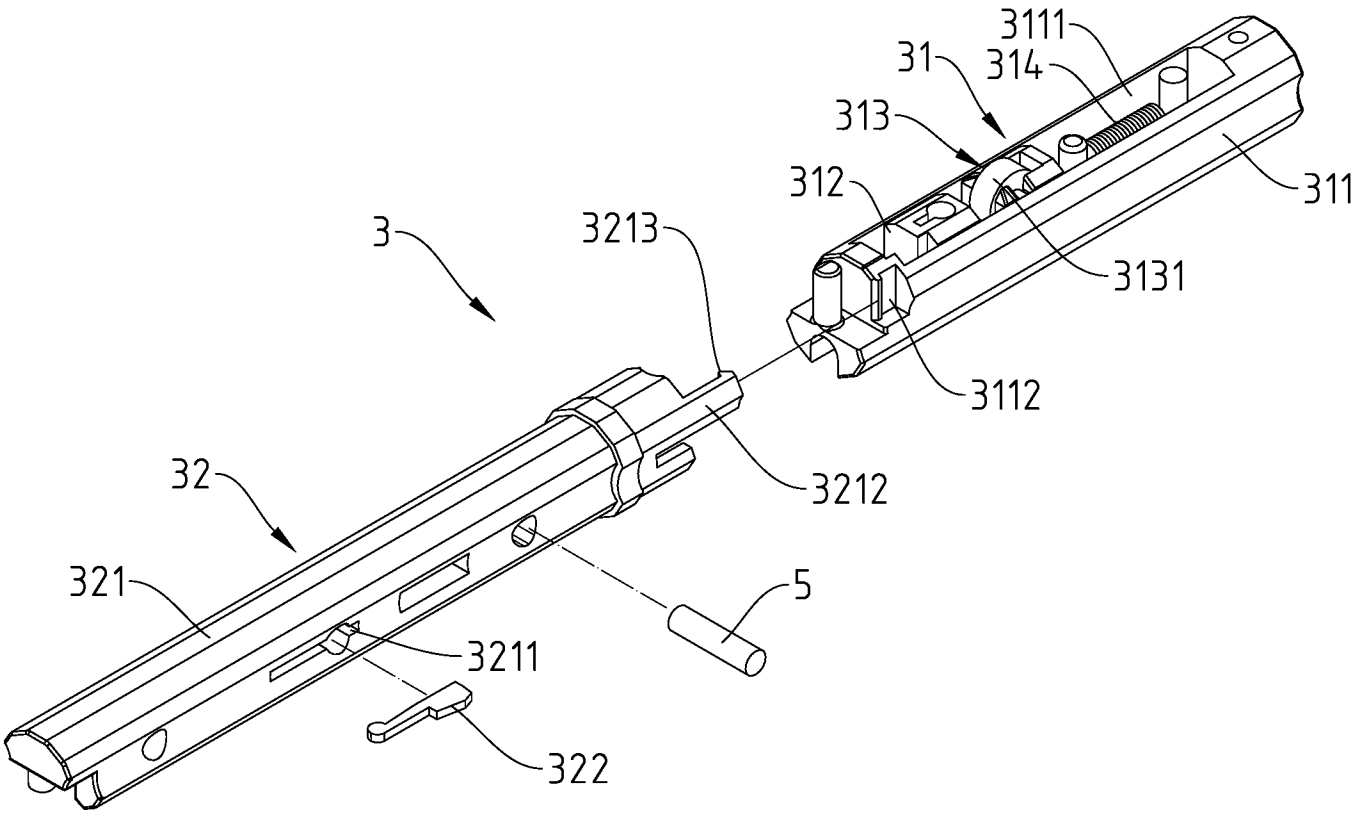
FIG. 4 is another exploded view of the control device set.

Referring to FIGS. 1-5 and FIGS. 9 and 10, a two-stage folding structure for two-fold inverted umbrella in accordance with the present invention is shown. The two-stage folding structure comprises an umbrella shaft assembly 1, and a control device set 3.

The umbrella shaft assembly 1 comprises an inner shaft tube 11, an outer shaft tube 12 axially slidably sleeved onto the inner shaft tube 11, a runner 14 axially slidably sleeved onto the outer shaft tube 12, and a handle 13 affixed to one end of the inner shaft tube 11 opposite to the outer shaft tube 12.

The inner shaft tube 11 has a through hole 111 disposed near one end thereof, and an elongated slot 112 disposed near an opposite end thereof. The outer shaft tube 12 has a first positioning hole 121 disposed near one end thereof, and a second positioning hole 122 disposed near an opposite end thereof.

The control device set 3 comprises a release mechanism 31, a positioning device 32, a spring member 33, a control device 34 and a linear connection device 35. The release mechanism 31 is fixedly mounted in the outer shaft tube 12 by a pin 4. The positioning device 3 is fixedly mounted in the inner shaft tube 11 by a pin 4. The positioning device 32 has a latch 322 located at one end thereof. The spring member 33 is connected between the release mechanism 31 and the positioning device 32. The control device 34 is mounted to the handle 13.

The release mechanism 31 comprises a base 311, a locating member 312, a positioning wheel 313, and a spring member 314. The base 311 is disposed inside the outer shaft tube 12, having a locating chamber 3111 located on one side thereof and a retaining notch 3112 disposed adjacent to the positioning device 32. The locating member 312 is mounted in the locating chamber 3111, having a recessed chamber 3121 and two pivot holes 3122 disposed in communication with the locating member 312 at two opposite sides. The positioning wheel 313 has a wheel body 3131, and a wheel axle 3132 protruded over two opposite sides of the wheel body 3131 and pivotally coupled to the pivot holes 3122 to keep the wheel body 3131 in abutment against an inside wall of the outer shaft tube 12. The spring member 314 is connected between the locating member 312 and the locating chamber 3111 of the base 311.

The positioning device 32 comprises a base 321 and the aforesaid latch 322. The base 321 is positioned in the inner shaft tube 11, having an arm 3212 disposed near the release mechanism 31 and terminated in a hook 3213 and a receiving hole 3211 located on one side thereof. The latch 322 is disposed in the receiving hole 3211. Further, an elastic member 323 is connected between one end of the latch 322 and the receiving hole 3211 so that the latch 322 is normally extended out of the inner shaft tube 11 through the through hole 111.

The control device 34 comprises a base 341 and a pusher 342. The base 341 is mounted inside the inner shaft tube 11, having a position-limiting groove 343 facing toward the elongated slot 112. The pusher 342 is disposed outside the handle 13. A fastening member 5 is inserted through the elongated slot 112 to affix the pusher 342 to the base 341. The fastening member 5 has a distal end thereof positioned in the position-limiting groove 343 on the base 341 of the control device 34 so that the base 341 can be moved axially in the inner shaft tube 11 within a predetermined range subject to the control of the fastening member 5.

The linear connection device 35 has two opposite ends thereof connected between the base 341 of the control device 34 and the locating member 312.

When the runner 14 is positioned in the other end of the outer shaft tube 12 remote from the handle 13, the outer shaft tube 12 is extended out of the inner shaft tube 11 to keep the first positioning hole 121 in alignment with the through hole 111 and the latch 322 extends out of the outer shaft tube 12 through the first positioning hole 121 to lock the outer shaft tube 12 and the inner shaft tube 11 in the extended position. At this time, the release mechanism 31 in the outer shaft tube 12 pulls up the spring member 33, and thus the spring member 33 is stretched.

Figure 6:
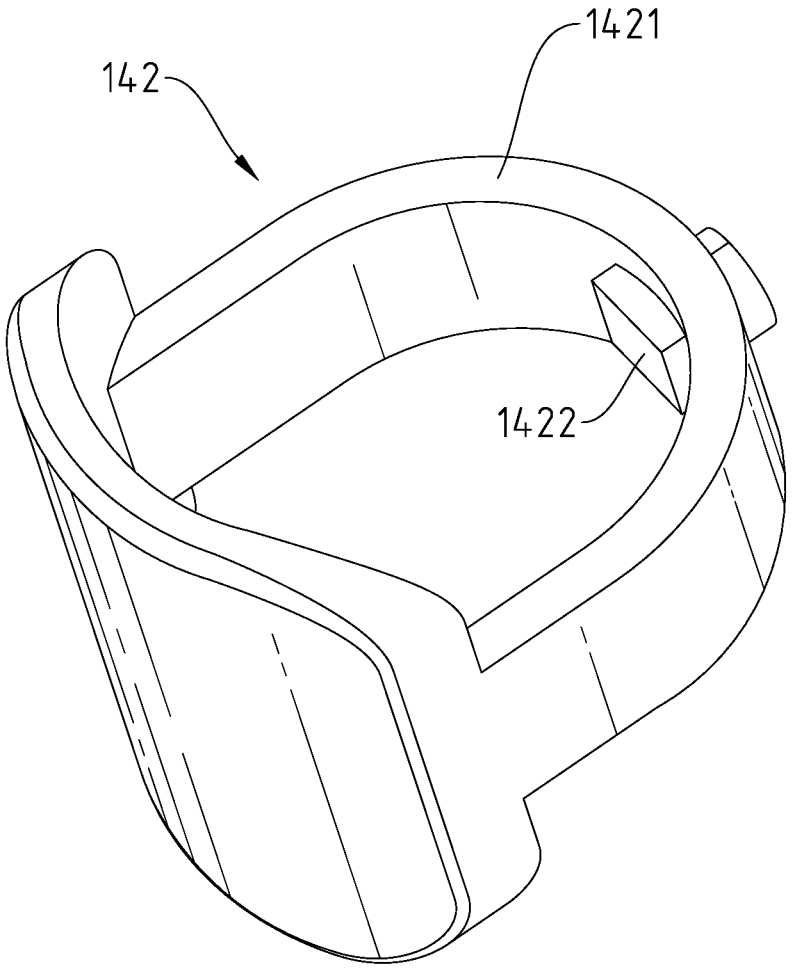
FIG. 6 is an elevational view of the retaining ring.
Figure 7:
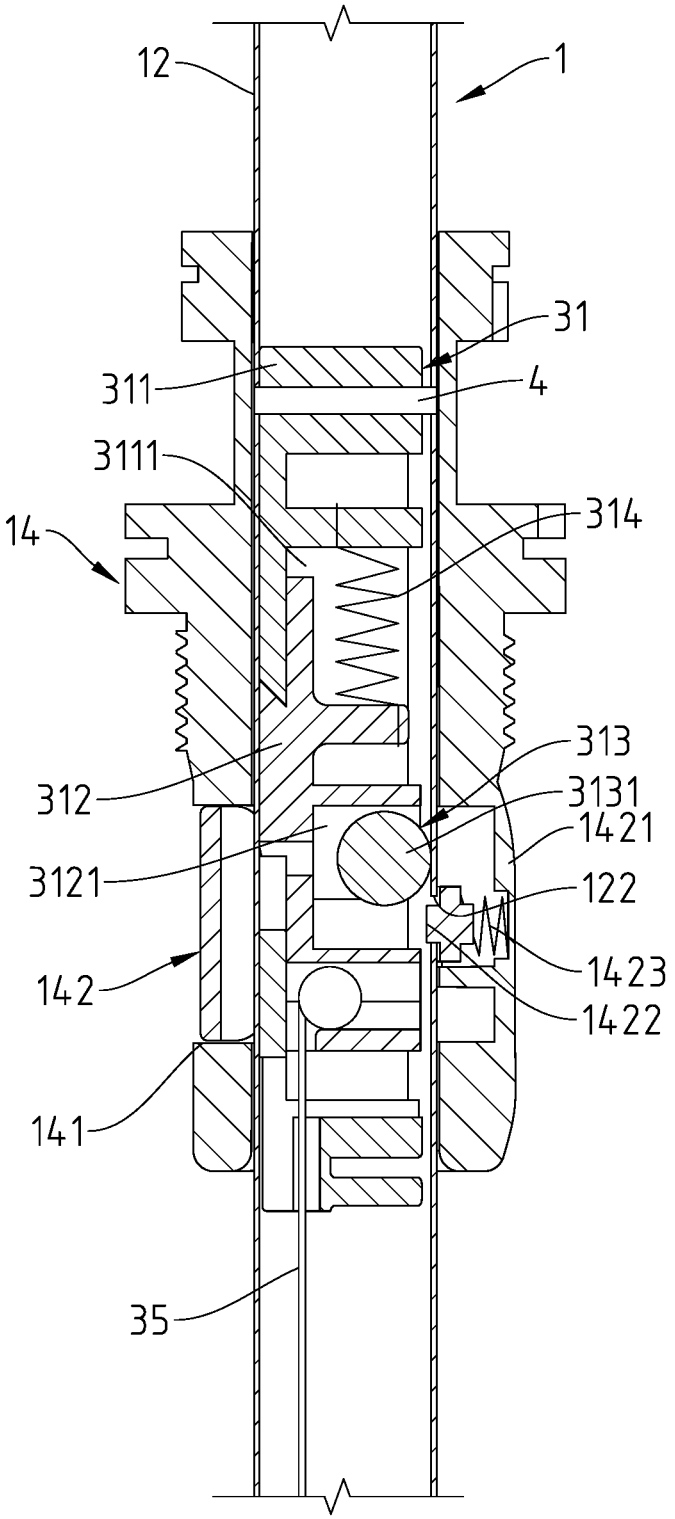
FIG. 7 is a sectional view illustrating the runner locked to the outer shaft tube.

Referring to FIGS. 6 and 7, the runner 14 of the umbrella shaft assembly 1 comprises a receiving hole 141, and a retaining ring 142 mounted in the receiving hole 141. The retaining ring 142 has a ring body 1421, and a retaining block 1422 protruded from the inner perimeter of the ring body 1421. Further, an elastic member 1423 is supported between the outer perimeter of the ring body 1421 and a bottom wall of the receiving hole 141. When the retaining block 1422 is disposed in alignment with the second positioning hole 122, the runner 14 is locked to the outer shaft tube 12.

Figure 5:
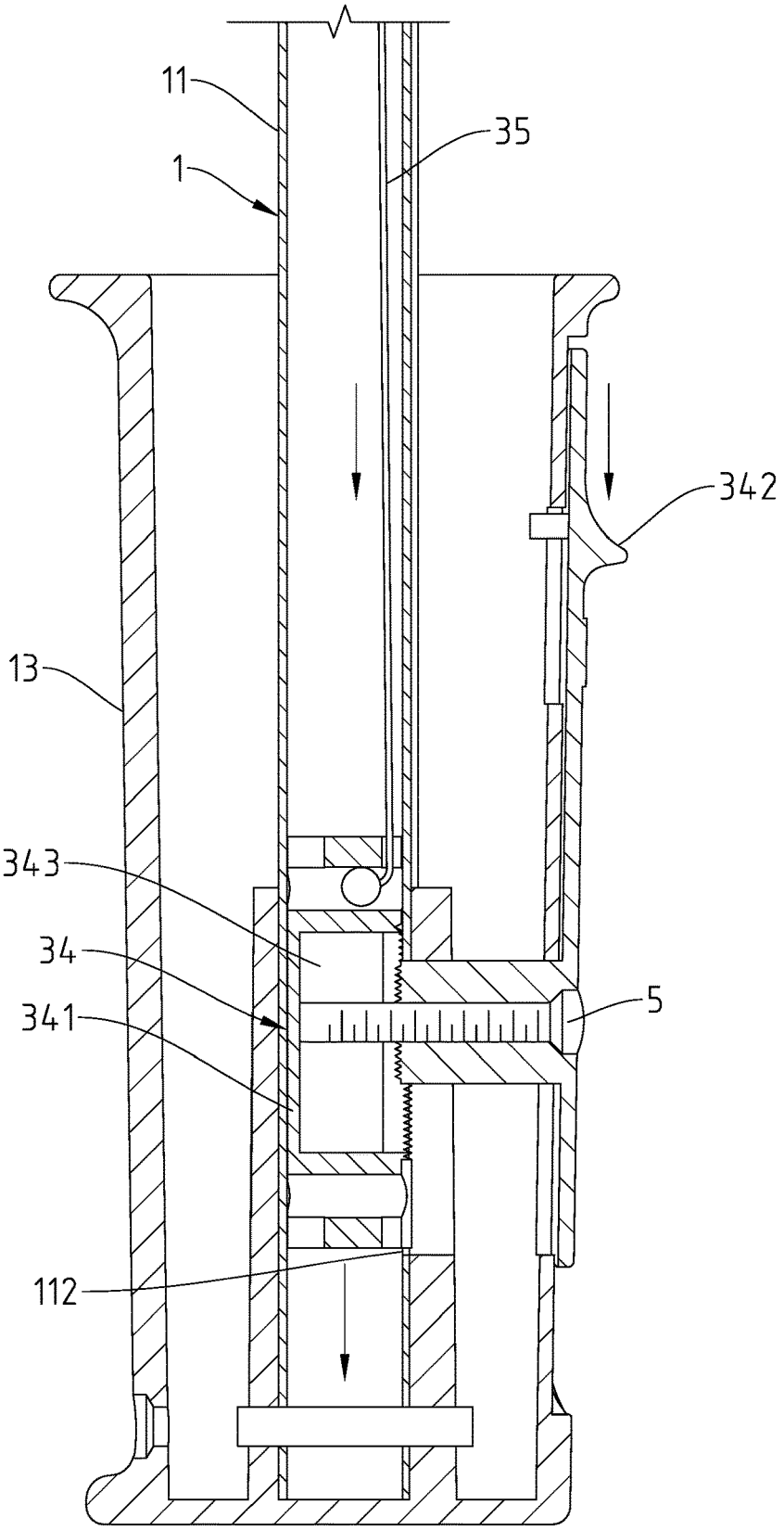
FIG. 5 is a sectional view of a part of the present invention, illustrating the relationship between the handle and the control device.
Figure 8:
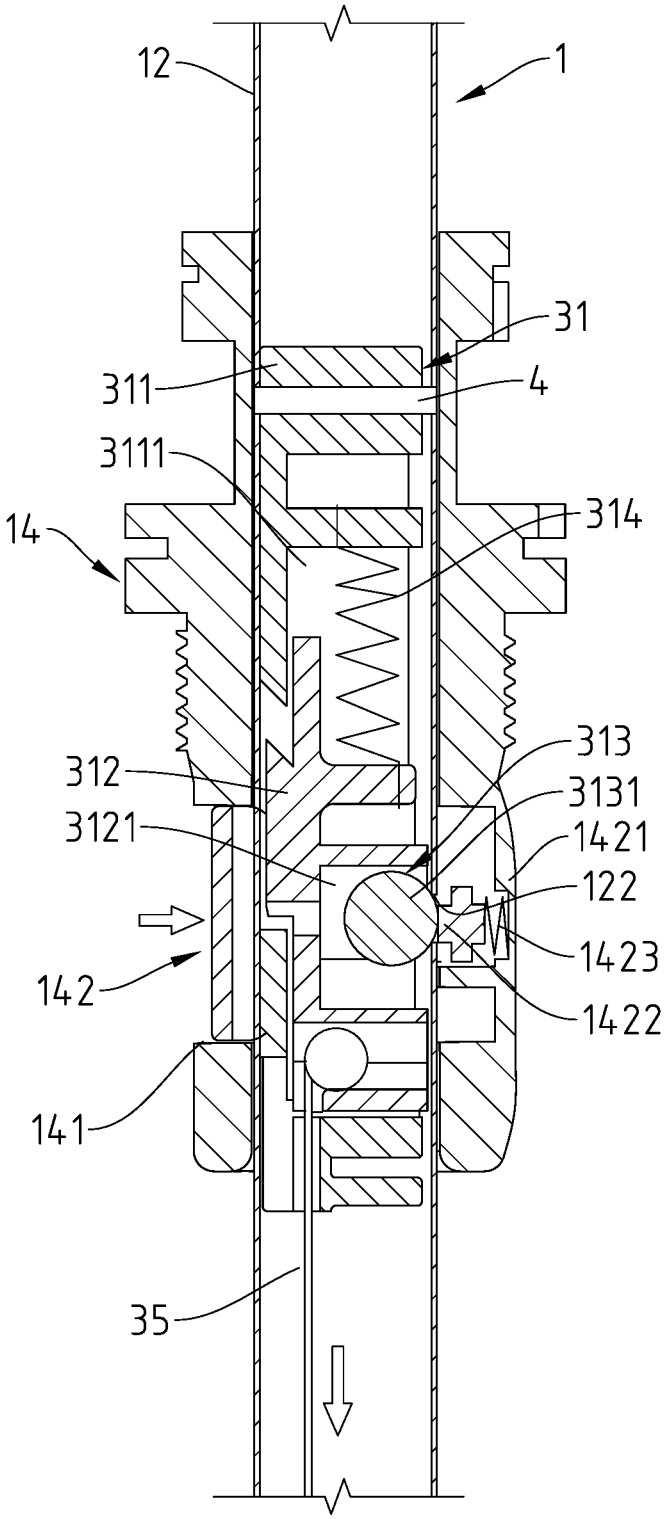
FIG. 8 is a schematic drawing, illustrating the runner unlocked from the outer shaft tube.
Figure 9:
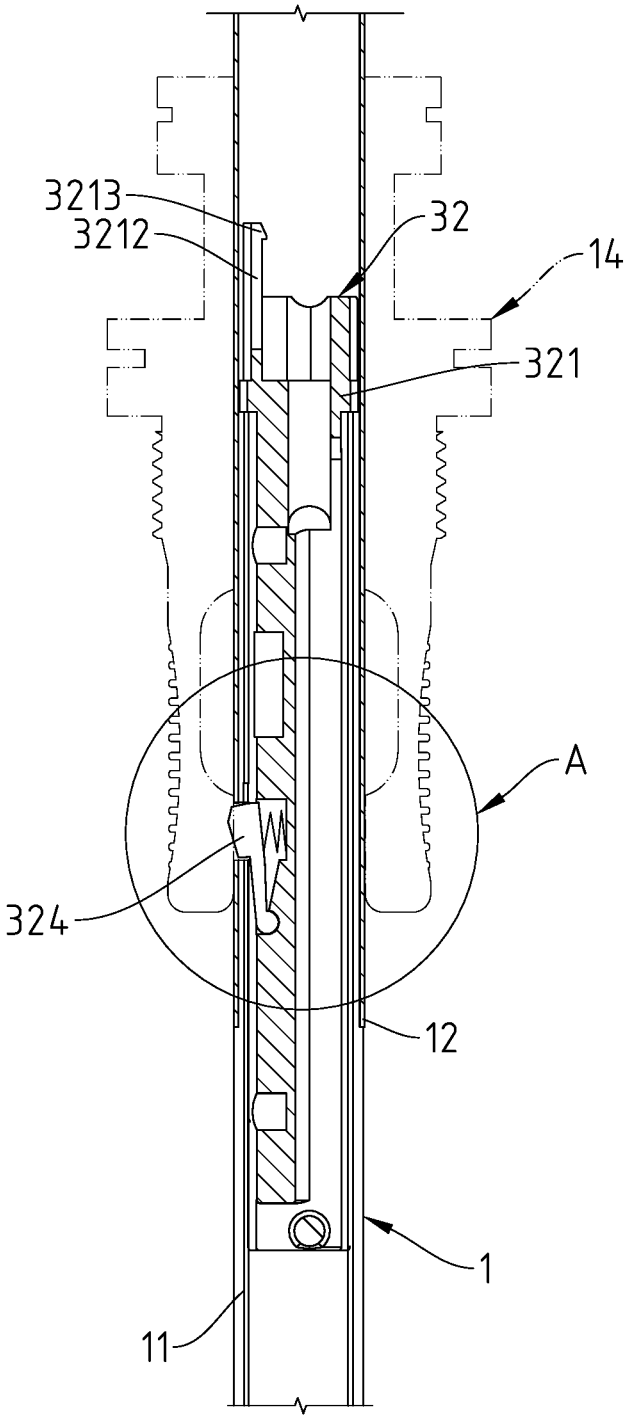
FIG. 9 is a schematic drawing of the present invention, illustrating the runner moved to the distal end of the outer shaft tube.
Figure 10:
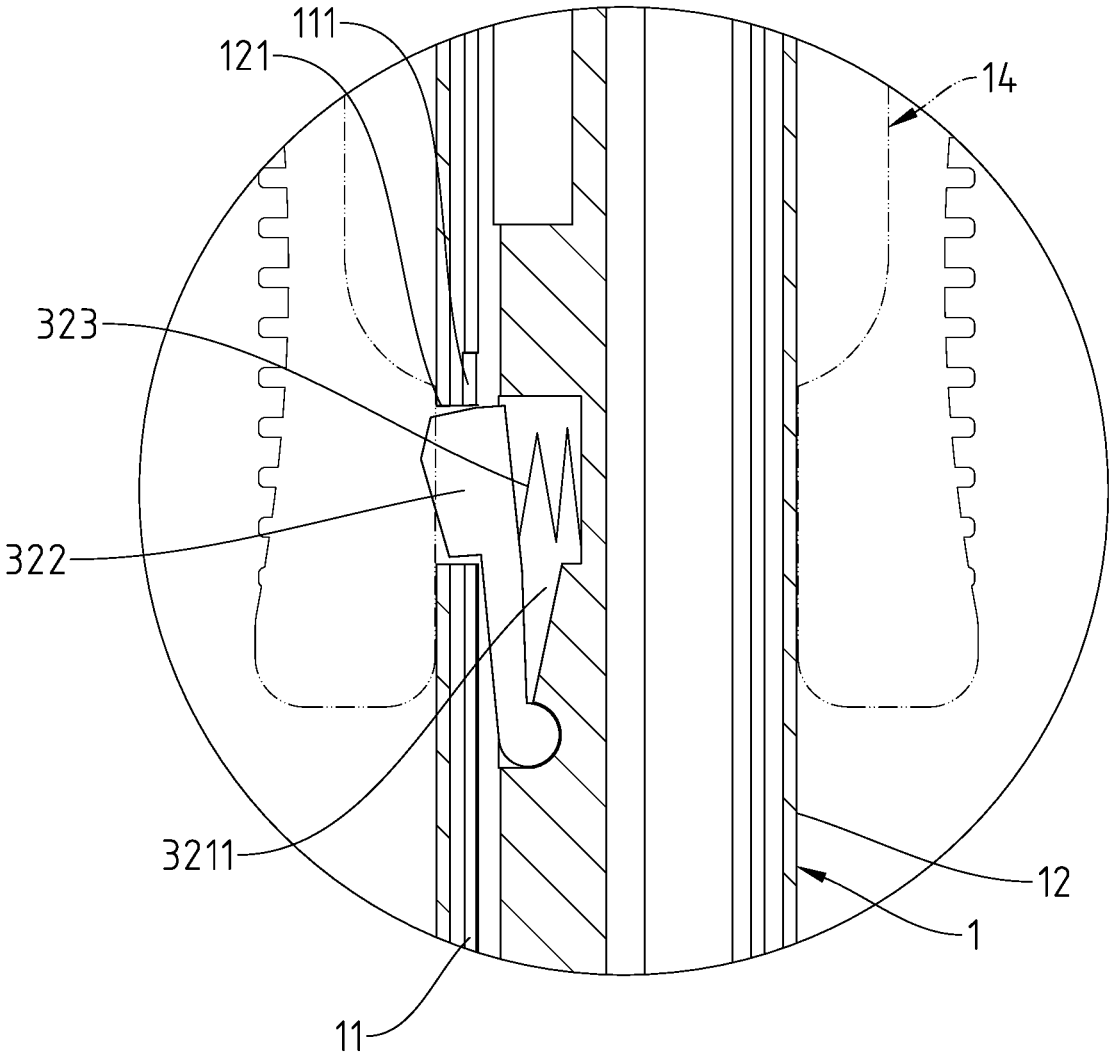
FIG. 10 is an enlarged view of Part A of FIG. 9.
Figure 11:
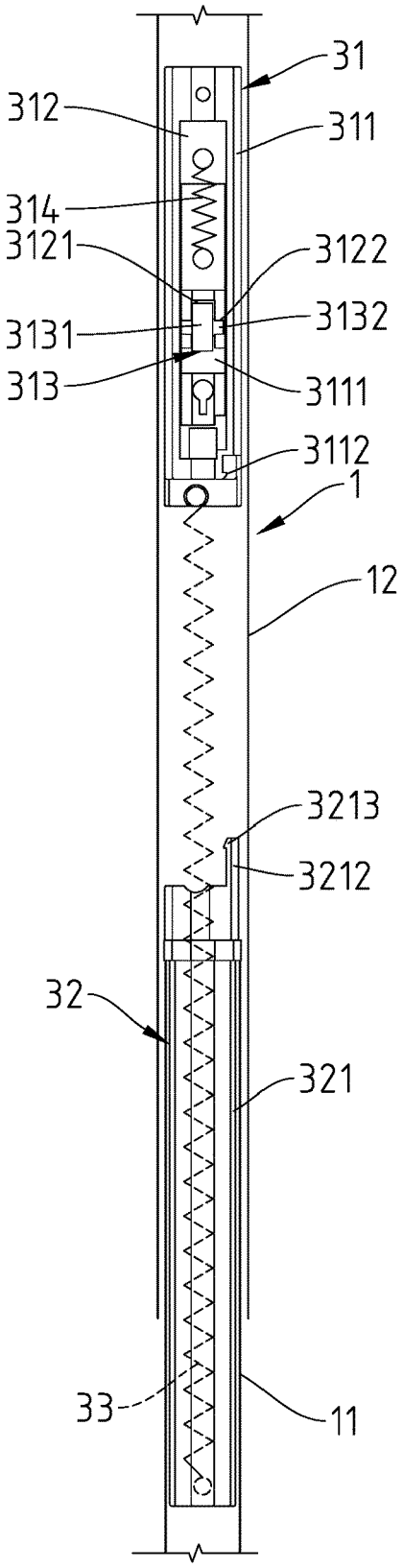
FIG. 11 is a schematic drawing of the present invention, illustrating the relationship between the release mechanism and the positioning device.
Figure 12:
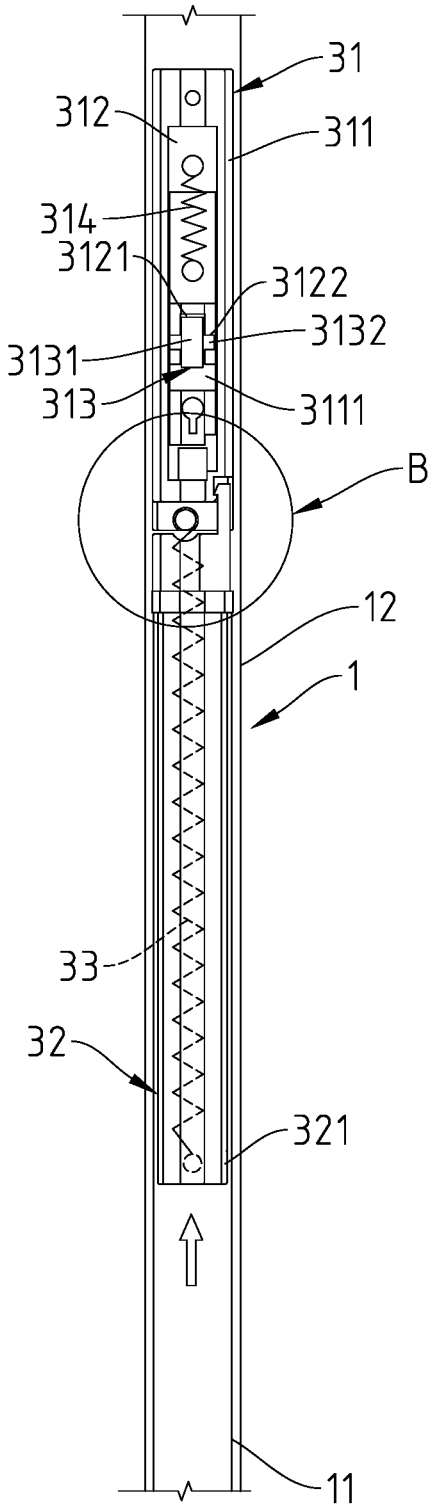
FIG. 12 is a schematic drawing of the present invention, illustrating the release mechanism and the positioning device locked.
Figure 13:
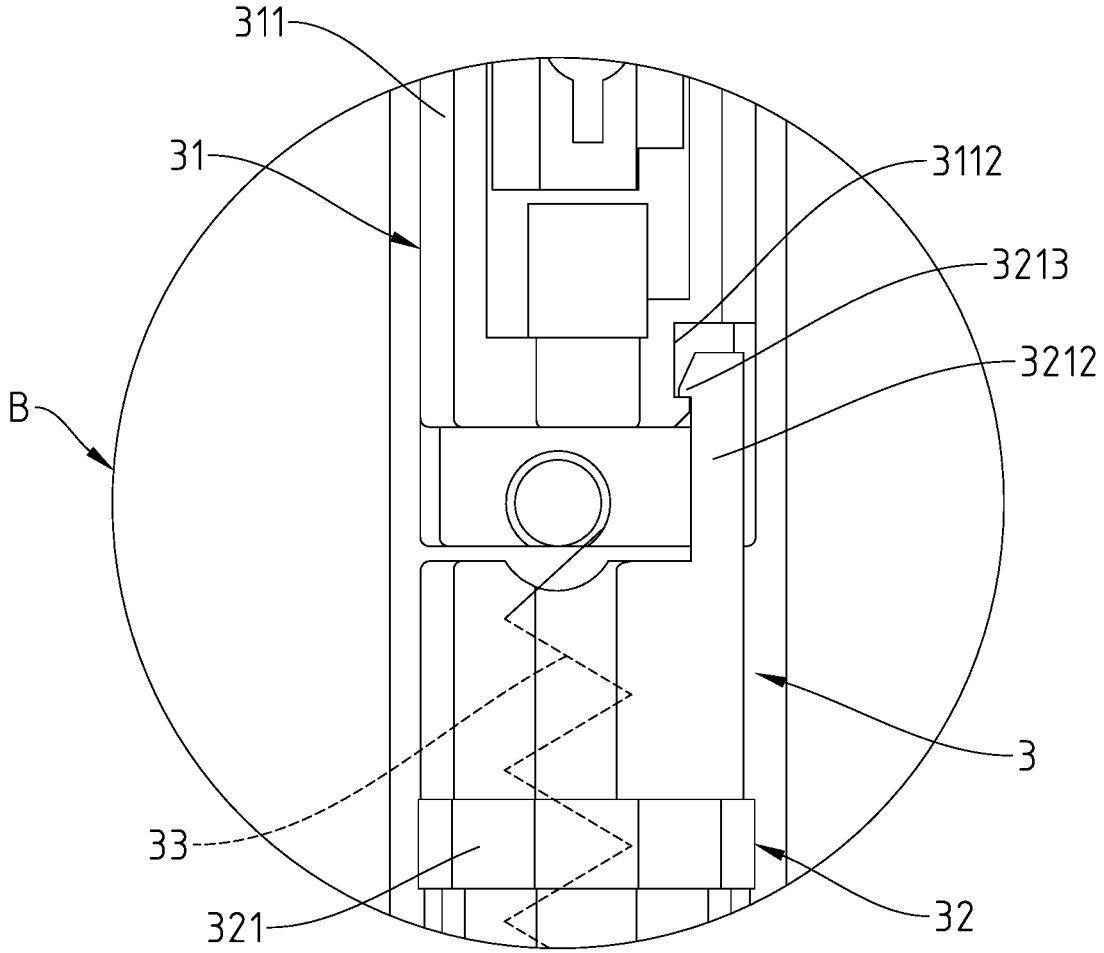
FIG. 13 is an enlarged view of Part B of FIG. 12.

Referring to FIGS. 5, 7 and 8, when the pusher 342 of the control device 34 is pushed downward by the user, it carries the base 341 of the control device 34 to move downward, causing the linear connection device 35 to pull the locating member 312, thus, the wheel body 3131 of the positioning wheel 313 pushes the retaining block 1422 of the runner 14 away from the second positioning hole 122 of the outer shaft tube 12 to unlock the runner 14 from the outer shaft tube 12. When the user releases the pressure from the pusher 342, the pusher 342 is returned, and the spring member 314 pulls the locating member 312 back to its former position.

Referring to FIGS. 9-13, when the runner 14 is unlocked from the outer shaft tube 12 and disposed near the distal end of the outer shaft tube 12, it forces back the latch 322 through the first positioning hole 121 of the outer shaft tube 12 into the inside of the through hole 111 of the inner shaft tube 11 to unlock the outer shaft tube 12 and the inner shaft tube 11. At this time, the spring member 33 of the control device set 3 will contract to pull the release mechanism 31 close to the positioning device 32, causing the outer shaft tube 12 and the inner shaft tube 11 to be received together where the hook 3213 is hooked in the retaining notch 3112 to lock the outer shaft tube 12 and the inner shaft tube 11 in the received position.

What the invention claimed is:

1. A two-stage folding structurer for two-fold inverted umbrella, comprising an umbrella shaft assembly and a control device set, said umbrella shaft assembly comprising an inner shaft tube, an outer shaft tube axially slidably sleeved onto said inner shaft tube, a runner axially slidably sleeved onto said outer shaft tube and a handle affixed to one end of said inner shaft tube opposite to said outer shaft tube, wherein:

said control device set comprising a release mechanism mounted inside said outer shaft tube, a positioning device mounted inside said inner shaft tube, a spring member connected between said release mechanism and said positioning device and a control device mounted to said handle, said release mechanism comprising a base and a retaining notch located on the base thereof near said positioning device, said positioning device comprising a base, an arm extended from the base thereof and terminating in a hook and a latch disposed at one side thereof; when said runner is positioned in a distal end of said outer tube remote from said handle, said outer shaft tube is extended from said inner shaft tube in an extended position and said latch is exposed to the outside of said outer shaft tube and said inner shaft tube to lock said outer shaft tube and said inner shaft tube in said extended position; when said control device is operated to actuate said release mechanism in unlocking said runner from said outer shaft tube, said runner is moved toward said handle to push said latch in unlocking said outer shaft tube from said inner shaft tube for enabling said spring member to receive said outer shaft tube to said inner shaft tube so that said release mechanism is moved close to said positioning device to engage said hook in said retaining notch in locking said outer shaft tube to said inner shaft tube in a received position.

2. The two-stage folding structurer for two-fold inverted umbrella as claimed in claim 1, wherein said inner shaft tube comprises a through hole through which said latch of said positioning device extends out of said inner shaft tube; said outer shaft tube comprises a first positioning hole, which is disposed in alignment with said through hole of said inner shaft tube for allowing said latch to extend out of said outer shaft tube in locking said outer shaft tube and said inner shaft tube in said extended position after said outer shaft tube is extended from said inner shaft tube.

3. The two-stage folding structurer for two-fold inverted umbrella as claimed in claim 2, wherein said positioning device comprises a receiving hole located on the base thereof; said latch is disposed in said receiving hole with one end thereof connected to said receiving hole by an elastic member.

4. The two-stage folding structurer for two-fold inverted umbrella as claimed in claim 1, wherein said outer shaft tube comprises a second positioning hole disposed in the remote end thereof remote from said handle; said runner comprises a receiving hole and a retaining ring mounted in said receiving hole, said retaining ring comprising a ring body, a retaining block protruded from an inner perimeter of said ring body and an elastic member supported between an outer perimeter of said ring body and a bottom wall of said receiving hole such that when said retaining block is disposed in alignment with said second positioning hole, said runner is locked to said outer shaft tube.

5. The two-stage folding structurer for two-fold inverted umbrella as claimed in claim 1, wherein the said base of said release mechanism is positioned in said outer shaft tube and provided with a locating chamber; said release mechanism comprises a locating member mounted in said locating chamber, a positioning wheel pivotally mounted to said locating member, and a spring member connected between said locating member and said locating chamber; said control device comprises a base mounted inside said inner shaft tube and a pusher affixed to the said base of said control device and disposed outside said handle; said control device set further comprises a linear connection device connected between the said base of said control device and said locating member such that when said pusher is operated, said linear connection device pulls said locating member to move in said locating chamber, causing said positioning wheel to push said runner away from the constraint of said outer shaft tube for allowing said runner to move relative to said outer shaft tube.

6. The two-stage folding structurer for two-fold inverted umbrella as claimed in claim 5, wherein said locating member of said release mechanism comprises a recessed chamber, and two pivot holes disposed in communication with said recessed chamber at two opposite sides; said positioning wheel comprises a wheel body, and a wheel axle protruded over two opposite sides of said wheel body and pivotally coupled to said pivot holes to keep the wheel body in abutment against an inside wall of said outer shaft tube.

* * * * *